US006626076B2

(12) United States Patent
Ozeki

(10) Patent No.: US 6,626,076 B2
(45) Date of Patent: Sep. 30, 2003

(54) PUNCH PRESS

(75) Inventor: Koji Ozeki, Inuyama (JP)

(73) Assignee: Murata Kikai Kabushiki Kaisha, Kyoto (JP)

( * ) Notice: Subject to any disclaimer, the term of this patent is extended or adjusted under 35 U.S.C. 154(b) by 0 days.

(21) Appl. No.: 10/161,595

(22) Filed: Jun. 5, 2002

(65) Prior Publication Data

US 2002/0194972 A1 Dec. 26, 2002

(30) Foreign Application Priority Data

Jun. 20, 2001 (JP) ..... 2001-186051

(51) Int. Cl.[7] ..... B26D 5/02
(52) U.S. Cl. ..... 83/527; 83/552
(58) Field of Search ..... 83/552, 527, 523, 83/549

(56) References Cited

U.S. PATENT DOCUMENTS 3,685,380 A * 8/1972 Daniels ..... 83/613
3,895,550 A * 7/1975 Daniels ..... 451/28 X
5,119,666 A * 6/1992 Fujiwara ..... 72/442
5,184,498 A * 2/1993 Hayashi ..... 83/542

FOREIGN PATENT DOCUMENTS

JP 52-27393 * 7/1977

* cited by examiner

*Primary Examiner*—Allan N. Shoap
*Assistant Examiner*—John Windmuller, Jr.
(74) *Attorney, Agent, or Firm*—Armstrong, Westerman & Hattori, LLP

(57) ABSTRACT

The punch press of the present invention is capable of selecting three tracks of the punch tool by a standard and low-priced cylinder device. The tool setting station with punch tool 4 is provided in the turret 3A that is rotatable around the center of the periphery. At least one of the tool setting stations is arranged with three punch tools in the turret diameter direction. The ram 11 comprises the ram main body 14 capable of elevating and descending, and the striker 15 which is provided transferable in the diameter direction at the lower part of the ram main body. The punch press comprises the link member 19 which is connected rotatable in both directions to the striker 15, and two cylinder devices 21A, 21B of which the piston rods 20A, 20B are connected rotatable to both ends of the link member.

5 Claims, 4 Drawing Sheets

PUNCH PRESS

FIELD OF THE INVENTION

The present invention relates to a punch press which adopts a turret, a cartridge or the like as a tool supporting body, and specifically to a punch press of three tracks type wherein three punch tools are arranged in a diameter direction of the turret, or in the direction orthogonal to the direction in which the cartridge advances.

BACKGROUND OF THE INVENTION

In the conventional turret punch press of three tracks type, a striker of a ram is transferred to a diameter direction of a turret, one punch tool of the three tracks is selected, and then a punching is carried out. For a means for transferring the striker of the ram in the diameter direction of the turret, a means adopting a cylinder device of two stage stroke wherein two pistons are arrange in series within the cylinder is publicly known (for example, the Japanese Patent Publication (Tokkou-Shou) No. 52-27393).

However, in the means adopting the cylinder device of two stage stroke, since the cylinder device is unique, it leads to the increase in the cost. In addition, since the cylinder device that is long in the diameter direction of the turret is necessary to be supported to the ram which carries out the punch operation, there is also a problem in the strength. In the punch press of the three tracks cartridge type, there are also similar problems.

The object of the present invention is to provide a punch press that is capable of selecting a punch tool of three tracks by using a general single stroke cylinder device, and obtaining sufficient supporting strength of the cylinder device.

SUMMARY OF THE INVENTION

The punch press of the present invention comprises a tool supporting body provided with a plurality of punch tools, and a ram for hitting the punch tool of the tool supporting body. The tool supporting body comprises three tracks of tool arrangement with an interval between each one. The ram comprises a ram main body which is capable of elevating and descending, a striker which is provided transferable in a direction separating from the three tracks at a lower part of the ram main body, a link member which is connected rotatable in both directions to the striker at the middle of a length direction, two cylinder devices wherein piston rods are connected rotatable to both ends of the link member, and a striker position control means for positioning the striker to the position corresponding to the three tracks by the combination of an advancing position and a receding position of the piston of both cylinder devices.

According to this structure, since two cylinder devices are connected to the link member that is rotatable in both directions and connected to the striker in the middle, by the combination of the advancing position and the receding position of these two cylinder devices, the position of the striker can be fixed to the position corresponding to three tracks. Therefore, for the cylinder device, a special and expensive device like the two stage stroke is not necessary, and the general cylinder device can be used. As a result, even when using two cylinder devices, the cost can be suppressed. Moreover, since the two cylinder devices can be provided to the ram main body individually, a supporting strength of the cylinder device to the ram main body and be obtained sufficiently.

Further, each of the three tracks in the tool supporting body is not necessarily required to be provided with a plurality of punch tools within the same track, and at least one punch tool is to be provided within the track.

In the present invention, the tool supporting member can be a turret. In the case the tool supporting member is the turret, the punch press of the present invention comprises a turret which includes a plurality of punch tools in the periphery direction and is a tool supporting body rotatable around the center of the periphery, and a ram which is provided capable of elevating and descending at a fixed position to the turret and hits the punch tool determined by the rotation of the turret. The turret is provided with three tracks of tool arrangement which differ in the diameter direction position. The ram comprises a ram main body which is capable of elevating and descending, a striker which is provided transferable in the direction separating from the three tracks at the lower part of the ram main body, a link member which is connected rotatable in both directions to the striker at the middle of the length direction, two cylinder devices of which the piston rods are connected rotatable to both ends of the link member, and a striker position control means for positioning the striker to the position corresponding to the three tracks by the combination of the advancing position and the receding position of the piston of both cylinder devices. The direction separating from the tracks is, for example, a diameter direction of the turret.

Further, each of the three tracks in the turret is not necessarily required to be provided with a plurality of punch tools within the same track, and at least one punch tool is to be provided within the track. For example, a tool setting station comprising the punch tool at the turret can be provided in a plurality in the periphery direction, and three punch tools can be arranged separating to the diameter direction of the turret within at least one tool setting station.

Both cylinder devices are provided so that the transferring direction of the piston rod is to be the direction separating from the three tracks, and the piston and the link member can be connected so that the transferring direction of the piston rod can be maintained. In the case of this structure, the swing of the cylinder main body of the cylinder device is not necessary, and since the operating section is small, the decrease in the support strength can be prevented.

Moreover, the cylinder device can be capable of switching the two positions of the advancing end and the receding end of the piston. Under the state in which both pistons are located at the advancing end or at the receding end, the striker can be located at a position corresponding to any one of the tracks among the three tracks, excluding the middle track. In addition, under the state in which one piston is located at the advancing end and the other piston is located at the receding end, the striker can be located at the position corresponding to the middle track. Under such structure, since it is not necessary to stop the piston of the cylinder device at the middle position, the control of the cylinder device is easy, and the switching control of the striker position can be carried out easily.

DETAILED DESCRIPTION OF THE PREFERRED EMBODIMENTS

Figure 1:
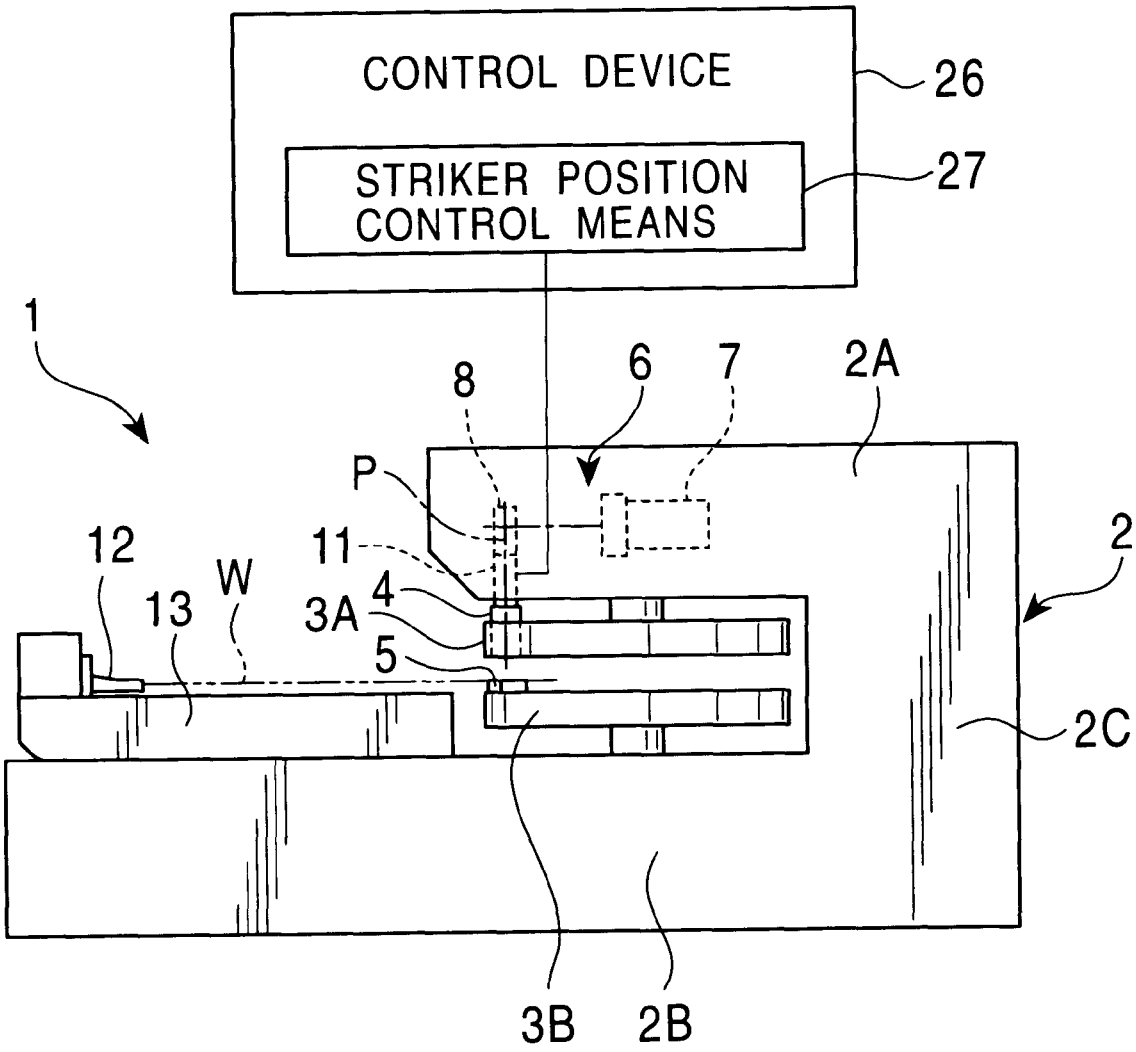
FIG. 1 is an explanatory view combined with a front view of the punch press and a block diagram of the control system according to the first embodiment of the present invention.

An embodiment of the present invention will be described along with FIG. 1 through FIG. 6. The embodiment is an example applied to a turret punch press. In a punch press 1, an upper turret 3A and a lower turret 3B which are tool supporting bodies are provided in a frame 2, and a ram 11 is provided capable of elevating and descending at a predetermined punch position P of the frame 2. The ram 11 is driven to elevate and descend by a punch drive device 6. The punch drive device 6 is formed with a servomotor 7, and a converting mechanism 8 for converting a rotation of the servomotor 7 into a straight reciprocating motion in the vertical direction. The converting mechanism 8 is formed of a crank mechanism. A work sheet W is transferred to front and back and to left and right on a table 13 by a work sheet feeding mechanism 12. The frame 2 is formed in the shape of the letter "C" from the side view with an upper frame section 2A, a lower frame section 2B, and a column section 2C. The turret 3A and the turret 3B are provided in the space between the upper frame section 2A and the lower frame section 2B of the frame 2. The turret 3A is supported by the upper frame section 2A and the turret 3B is supported by the lower frame section 2B, both in the manner rotatable around the center of the circumference.

Figure 2:
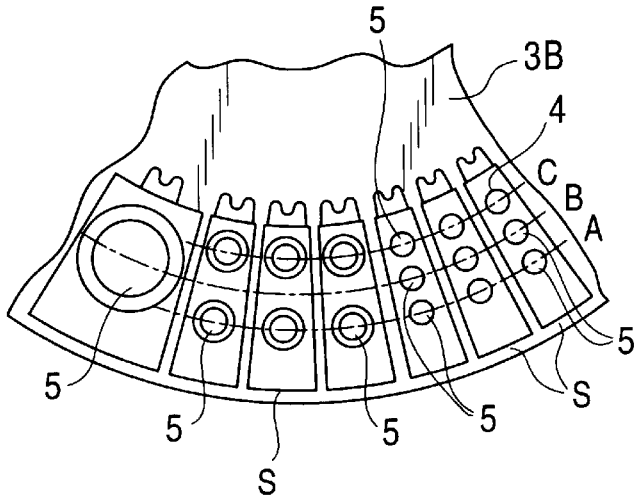
FIG. 2 is a partial plain view of the lower turret in the punch press of the same.

The upper turret 3A and the lower turret 3B are provided with a plurality of tool setting stations arranged in the periphery direction. FIG. 2 shows a section of the plain view of the lower turret 3B. In the lower turret 3B, a tool setting station S provided with a die tool 5 is provided in a plurality on the periphery.

The upper turret 3A and the lower turret 3B are provided with three tracks A~C of the tool arrangement which differ in the diameter direction position. Among the tool setting stations S, at least one tool setting station S is assumed to be arranged with three tools 4, 5 which are located at each of the three tracks A~C of the tool arrangement.

Figure 3:
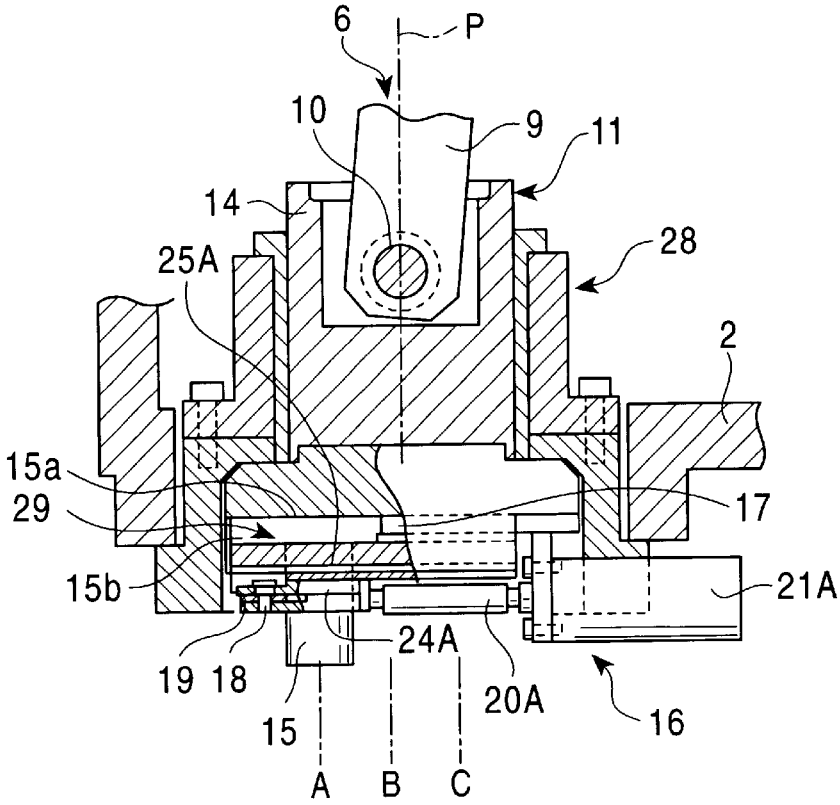
FIG. 3 is a sectional side view of the ram in the punch press of the same.

As shown in the sectional view of FIG. 3, the ram 11 is provided capable of elevating and descending to a ram guide 28 that is provided at the frame 2, at the punch position P of a fixed position. The ram 11 is connected to a lower end of a crank arm 9 of a punch drive mechanism 6 via a pin 10.

Figure 4:
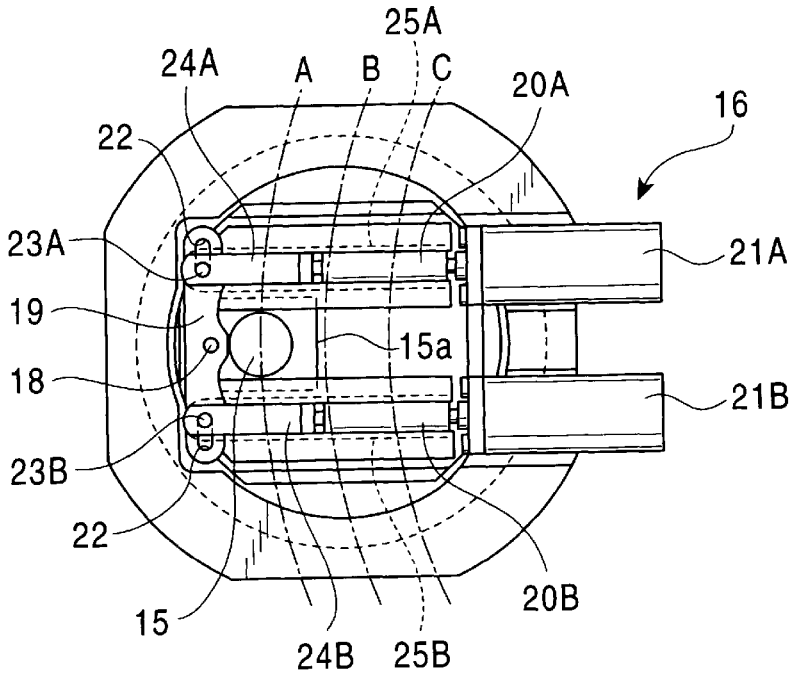
FIG. 4 is a bottom view of the ram.
Figure 5:
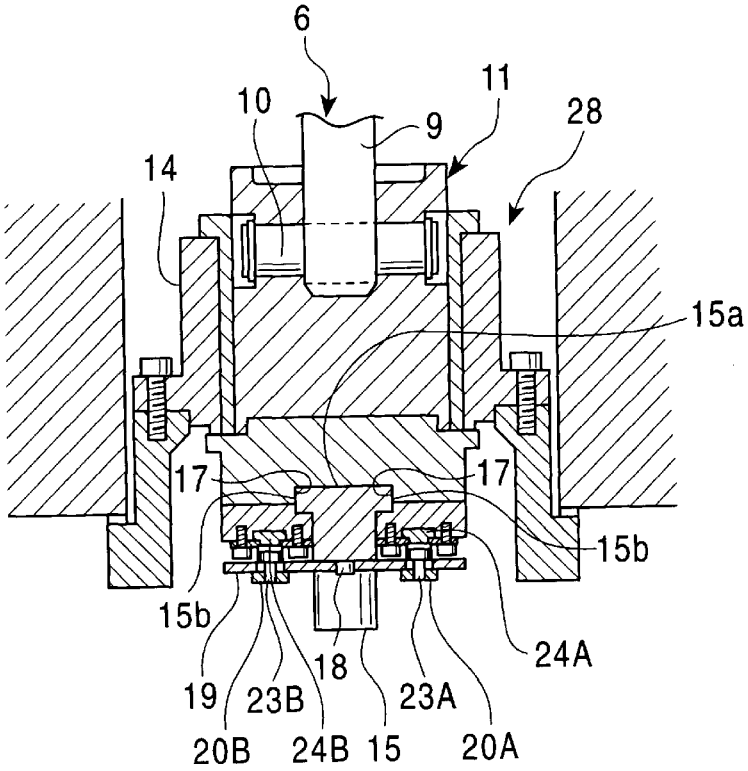
FIG. 5 is a front sectional view of the ram.

FIG. 4 is a bottom view of the ram 11, and FIG. 5 is a sectional view of the ram 11 from the turret diameter direction. The ram 11 comprises a ram main body 14 that is capable of elevating and descending, a striker 15 that is provided transferable in the diameter direction of the upper turret 3A and the lower turret 3B at the lower part of the ram main body 14 via a guide means 29, and a striker transferring mechanism 16 for transferring the striker 15. The guide means 29 is formed by guide protrusions 15*b*, 15*b* which are protruding at both ends of an upper end base 15*a* of the striker 15, connected slidable to a striker guide groove 17 that extends in the turret diameter direction formed in the ram main body 14.

The striker transferring mechanism 16 comprises a link member 19, and two cylinder devices 21A, 21B of which piston rods 20A, 20B are rotatably connected to both ends of the link member 19, respectively. The link member 19 is rotatably connected in both directions at a lower surface of the upper end base 15*a* of the striker 15 via a pin 18 at the middle of the length direction. Both cylinder devices 21A, 21B are capable of switching the two positions of an advancing end and a receding end of the piston, and are provided so that the transferring direction of the piston rods 20A, 20B are to be parallel to the turret diameter direction. In this case, both cylinder devices 21A, 21B are provided so that the turret outer diameter side is facing the advancing side of the piston. The piston rods 20A, 20B and the link member 19 are connected so that the parallel transferring direction of the piston rods 20A, 20B can be maintained. In other words, at both ends of the link member 19, long holes 22, 22 which extend in the length direction are formed, and each tip section of the piston rods 20A, 20B are connected rotatable via pins 23A, 23B which are connecting to each long hole 22 respectively. Moreover, the each of the piston rods 20A, 20B comprises guide sections 24A, 24B respectively, and by engaging these guide sections 24A, 24B to rod guide grooves 25A, 25B which extend in the turret diameter direction provided at the lower surface of the ram main body 14, the piston rods 20A, 20B are capable of transferring in the turret diameter direction along the rod guide grooves 25A, 25B.

A control device 26 (FIG. 1) controls the entire operation of the punch press 1. The control device 26 comprises a striker position control means 27 for controlling the striker transferring mechanism 16. The striker position control means 27 fixes the position of the striker 15 to the diameter direction position corresponding to the three punch tools 4 arranged in the diameter direction of the upper turret 3A, by the combination of the advancing position and the receding position of the piston of both cylinder devices 21A, 21B.

Next, the operation for selecting and setting the position of the striker 15 by the control of the striker transferring mechanism 16 by the striker position control means 27 will be described in reference to FIG. 6.

Figure 6A:
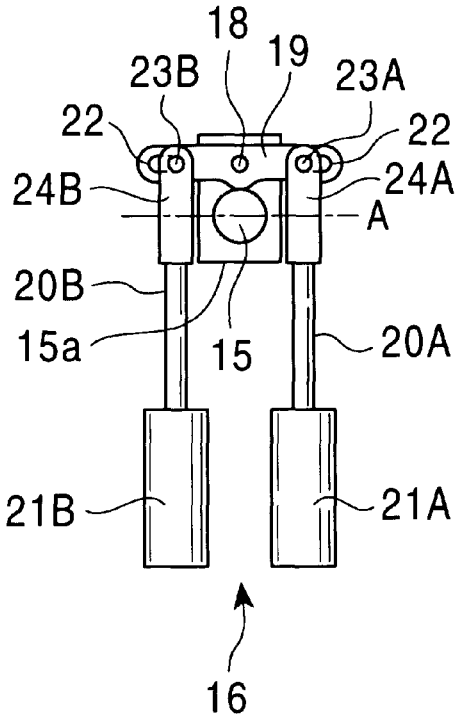
FIG. 6 is a view useful for explaining the control operation of the striker position.

In the case both cylinder devices 21A, 21B are operated so that both pistons of the cylinder devices 21A, 21B are to be located at the advancing end, as shown in FIG. 6A, the link member 19 advances to the turret outer periphery side by being maintained in a form orthogonal to both piston rods 20A, 20B. Then, the striker 15 is located at the track A of the outside diameter side, in other words, at the diameter direction position corresponding to the punch tool 4 of the outer side among the three punch tools 4 arranged in the turret diameter direction. In this case, the punch tool 4 of the outer side position is selected as the tool to be punched.

Figure 6B:
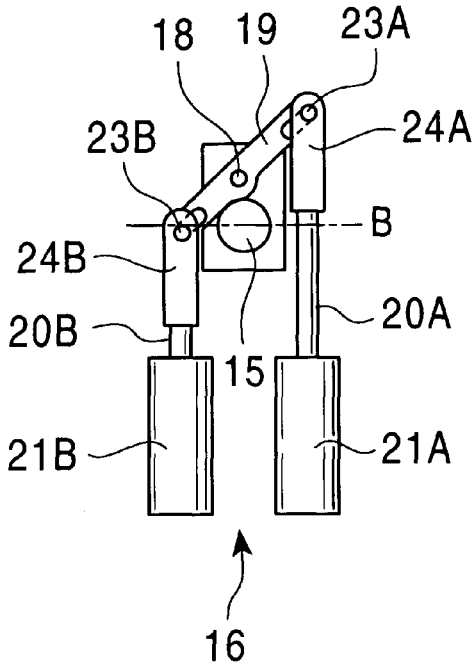

Moreover, in the case either one of the cylinder devices 21A (21B) is operated so that the piston is to be located at the advancing end, and also the other cylinder device 21B (21A) is operated so that the piston is to be located at the receding end, as shown in FIG. 6B, the link member 19 becomes inclining to both piston rods 20A, 20B. Under this state, the striker 15 is located at the middle track B, in other words, at the diameter direction position corresponding to the middle punch tool 4 among the three punch tools 4 arranged in the turret diameter direction. In this case, the punch tool 4 of the middle position is selected as the tool to be punched.

Figure 6C:
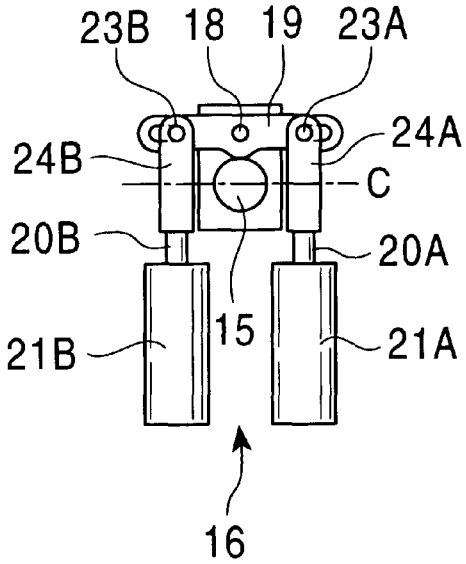

Furthermore, in the case both cylinder devices 21A, 21B are operated so that both pistons are to be located at the receding end, as shown in FIG. 6C, the link member 19 recedes to the inner diameter side of the turret by being maintained in a form orthogonal to both piston rods 20A, 20B. Under this state, the striker 15 is located at the track C of the inner diameter side, in other words, at the diameter direction position C corresponding to the inner side punch tool 4 among the three punch tools 4 arranged in the turret diameter direction. In this case, the punch tool 4 of the inner side position is selected as the tool to be punched.

As in the manner stated above, the punch press 1 comprises the link member 19 connected rotatable in both directions to the striker 15, and the two cylinder devices 21A, 21B of which the piston rods 20A, 20B are connected rotatable to the both ends of the link member 19 respectively, and the position of the striker 15 is determined to the diameter direction position corresponding to the three tracks A~C according the combination of the advancing position and the receding position of the pistons of the both cylinder devices 21A, 21B. Therefore, by using a more general and low-priced cylinder device and not by a special and expensive cylinder device, the transferring of the striker position can be carried out for selecting the punch tool. Moreover, the support strength of the cylinder devices 21A, 21B to the ram main body 14 can be obtained sufficiently.

The both cylinder devices 21A, 21B are provided so that the transferring direction of the piston rods 20A, 20B are to be parallel to the turret diameter direction, and the piston rods 20A, 20B and the link member 19 are connected so that the parallel transferring direction of the piston rods 20A, 20B can be maintained. Therefore, the operating section can be small, and the decrease in the support strength can be prevented.

Moreover, the both cylinder devices 21A, 21B are capable of switching the two positions of the advancing end and the receding end of the piston. In the case both pistons are located at the advancing end or at the receding end, the striker 15 is located at the diameter direction position corresponding to the punch tool 4 of the outer side or the inner side among the three punch tools 4.

In the case one piston is located at the advancing end and the other piston is located at the receding end, the striker 15 is located at the diameter direction position corresponding to the middle punch tool 4. Therefore, it is not necessary to stop the pistons of the cylinder device 21A, 21B at the middle position, and the position control of the striker 15 can be carried out easily.

Further, the abovementioned embodiment was described for the case in which it is applied to the turret punch press, however, the present invention can also be applied to the case in which the tool supporting body is a cartridge of a rectangular shape or the like (not shown in the drawings). For example, the cartridge which is the tool supporting body advances and recedes linearly relative to the frame, and the tracks of the tool arrangement can be arranged in parallel away to the direction orthogonal to the receding direction. The cartridge can be used by being fixed onto the frame, or the positioning of the tool in one direction to the work can be carried out by the cartridge being transferred linearly to the frame.

The punch press of the present invention comprises the tool supporting body provided with a plurality of punch tools, and the ram for hitting the punch tool of the tool supporting body. The tool supporting body comprises three tracks of tool arrangement with an interval between each one. The ram comprises the ram main body which is capable of elevating and descending, the striker which is provided transferable in the direction separating from the three tracks at the lower part of the ram main body, the link member which is connected rotatable in both directions to the striker at the middle of the length direction, two cylinder devices wherein the piston rods are connected rotatable to both ends of the link member, and the striker position control means for positioning the striker to the position corresponding to the three tracks according to the combination of the advancing position and the receding position of the pistons of both cylinder devices. Therefore, by using the general single stroke cylinder device, the selection of the punch tool of three tracks can be carried out, and the support strength of the cylinder device can be obtained sufficiently.

In the case the tool supporting body is the turret, by using the abovementioned general single stroke cylinder device, the selection of the punch tool of the three tracks can be carried out even more efficiently.

In the case both cylinder devices are provided so that the transferring direction of the piston rod is to be the direction separating from the three tracks, and the piston and the link member are connected so that the transferring direction of the piston rod can be maintained, the swing of the cylinder main body of the cylinder device is not necessary, the operating section can be small, and the decrease in the support strength can be prevented.

When the cylinder device is capable of switching the two positions of the advancing end and the receding end of the pistons, under the state in which both pistons are located at the advancing end or at the receding end, the striker can be located at a position corresponding to any one of the tracks among the three tracks excluding the middle track, and under the state in which one piston is located at the advancing end and the other piston is located at the receding end, the striker can be located at the position corresponding to the middle track. Under such structure, since it is not necessary to stop the piston of the cylinder device at the middle position, the control of the cylinder device is simple, and the switching control of the striker position can be carried out easily.

What is claimed is:

1. A punch press comprising:

a tool supporting body provided with a plurality of punch tools; and a ram for hitting the plurality of punch tools of the tool supporting body;

wherein the tool supporting body includes three tracks of tool arrangement; and wherein the ram comprises a ram main body capable of elevating and descending a striker that is located at a lower portion of the ram main body, a link member with two ends is rotatably connected to the striker by a mid-section of the link member, two cylinder devices with two piston rods are each rotatably connected to each of the two ends of the link member, and a striker position control means for positioning the striker to a position corresponding to each of the three tracks by a combination of advancing and receding each of the piston rods of the cylinder devices.

2. A punch press comprising:

a turret serving as a tool supporting body with a periphery holding a plurality of punch tools along a periphery direction; and a ram capable of elevating and descending at a fixed position relative to the turret, and hits the punch tool determined by a rotation of the turret;

wherein the turret includes three tracks, each located at a different radial distance from an axis about which the turret rotates; and wherein the ram comprises a ram main body capable of elevating and descending a striker that is transferably located at a lower portion of the ram main body, a link member with two ends is rotatably connected to the striker by a mid-section of the link member, two cylinder devices with two piston rods are each rotatably connected to each of the two ends of the link member, and a striker position control means for positioning the striker to a position corresponding to each of the three tracks by a combination of advancing and receding each of the piston rods of the cylinder devices.

3. A punch press according to claim 1 or claim 2, wherein the cylinder devices are provided so that a traveling direction of each of the piston rods determines which one of the three tracks to be reached, and the pistons and the link member are connected so that proper traveling of the piston rods can be maintained.

4. A punch press according to claim 1 wherein each of the cylinder devices is capable of switching two positions between an advancing end and a receding end, and under a state in which both pistons are located at the advancing end or at the receding end, the striker is located at a position corresponding to anyone of the three tracks excluding middle track, and under a state in which one of the pistons is located at the advancing end and the other piston is located at the receding end, the striker is located at a position corresponding to a middle track.

5. A punch press according to claim 3 wherein each of the cylinder devices is capable of switching two positions between an advancing end and a receding end, and under a state in which both pistons are located at the advancing end or at the receding end, the striker is located at a position corresponding to any one of the three tracks excluding a middle track, and under a state in which one of the pistons is located at the advancing end and the other piston is located at the receding end, the striker is located at a position corresponding to a middle track.

* * * * *